US006854173B2

(12) United States Patent
Hippe

(10) Patent No.: US 6,854,173 B2
(45) Date of Patent: Feb. 15, 2005

(54) FASTENER INSTALLATION APPARATUS AND ASSOCIATED METHOD

(75) Inventor: Daniel A. Hippe, Seattle, WA (US)

(73) Assignee: The Boeing Company, Seattle, WA (US)

( * ) Notice: Subject to any disclaimer, the term of this patent is extended or adjusted under 35 U.S.C. 154(b) by 248 days.

(21) Appl. No.: 10/190,737

(22) Filed: Jul. 8, 2002

(65) Prior Publication Data

US 2004/0003491 A1 Jan. 8, 2004

(51) Int. Cl.[7] ..... B23P 19/02; B25B 27/14

(52) U.S. Cl. ..... 29/525; 29/525.01; 29/525.08; 29/446; 29/252; 29/276

(58) Field of Search ..... 29/525, 525.01, 29/525.08, 446, 452, 790, 718, 281.3, 243.54, 252, 257, 276, 249; 81/9.41, 9.42, 9.43

(56) References Cited

U.S. PATENT DOCUMENTS 3,257,724 A * 6/1966 Wilterdink et al. ..... 30/228
3,390,446 A * 7/1968 Ettorre ..... 29/252
3,412,451 A * 11/1968 Vieser et al. ..... 227/2
3,940,123 A 2/1976 Herbener et al.
3,942,570 A 3/1976 Bochman, Jr. et al.
3,979,351 A 9/1976 Sekhon
3,983,304 A 9/1976 Sekhon
4,043,000 A 8/1977 Bunker
4,068,555 A 1/1978 Volkman
4,112,992 A 9/1978 Wing
4,203,204 A 5/1980 Murphy
4,215,953 A 8/1980 Perraud
4,216,585 A 8/1980 Hatter
4,229,124 A 10/1980 Frey et al.
4,237,768 A 12/1980 Volkmann
4,285,377 A 8/1981 Hart
4,310,181 A 1/1982 Welsh et al.

(List continued on next page.)

FOREIGN PATENT DOCUMENTS

WO WO 01/096071 A1 * 12/2001

*Primary Examiner*—Marc Jimenez
(74) *Attorney, Agent, or Firm*—Alston & Bird LLP

(57) ABSTRACT

The fastener installation apparatus and method of the present invention include a housing and a moveable body at least partially within the housing. The moveable body defines a plurality of openings and is fixably attached to at least one piston, which is in moveable contact with the housing. First and second cavities are defined on opposite sides of the piston and respective openings in the moveable body are in communication with opposite sides of the piston. In addition, a valve directs a fluid through the appropriate openings in the moveable body and into the first cavity or the second cavity, as desired, which, in turn, alternately extends and retracts the moveable body relative to the housing. A jaw extends from the housing in alignment with the moveable body, such that the jaw and the moveable body cooperate to install a fastener upon extension of the moveable body.

24 Claims, 4 Drawing Sheets

U.S. PATENT DOCUMENTS 4,310,964 A 1/1982 Murphy
4,355,531 A 10/1982 Rosman
4,365,401 A * 12/1982 Ogren ..... 29/243.53
4,398,850 A 8/1983 Talvensaari
4,408,936 A 10/1983 Williamson
4,420,277 A 12/1983 Hibbard et al.
4,479,666 A 10/1984 Welsh et al.
4,485,510 A 12/1984 Hatter
4,539,872 A 9/1985 Bochman, Jr.
4,593,583 A 6/1986 Singleton
4,624,155 A 11/1986 Wing
4,671,715 A 6/1987 Berg
4,713,990 A 12/1987 Poling
4,756,652 A 7/1988 Hatter
4,759,888 A 7/1988 Brest van Kempen
4,815,907 A 3/1989 Williamson et al.
4,819,522 A 4/1989 Stinson
4,823,653 A 4/1989 Batten
4,877,363 A 10/1989 Williamson et al.
4,919,577 A 4/1990 Binns
4,924,734 A 5/1990 Bochman, Jr.
4,931,322 A 6/1990 Yamamoto et al.
4,957,401 A 9/1990 Hatter
4,971,501 A 11/1990 Chavez
4,990,022 A 2/1991 Watanabe et al.
5,011,352 A 4/1991 Hatter
5,058,252 A 10/1991 Wiesner, III et al.
5,069,524 A 12/1991 Watanabe et al.
5,098,227 A 3/1992 Wright
5,098,238 A 3/1992 Batchelor et al.
5,109,735 A 5/1992 Hart
5,111,018 A 5/1992 Nishiwaki et al.
5,117,667 A 6/1992 Hatter
5,135,340 A 8/1992 Stinson
5,180,265 A 1/1993 Wiese
5,231,903 A 8/1993 Bockman, Jr.
5,240,745 A 8/1993 Yamamoto et al.
5,280,673 A 1/1994 Zieve et al.
5,437,094 A 8/1995 Zieve et al.
5,439,339 A 8/1995 Batchelor
5,465,490 A * 11/1995 Smith et al. ..... 30/180
5,526,669 A 6/1996 Gjovik et al.
5,533,849 A 7/1996 Burdick
5,562,379 A 10/1996 Rausch et al.
5,709,287 A 1/1998 Bochman
5,746,953 A 5/1998 Sakurai et al.
5,775,974 A 7/1998 Hulsebus
5,803,924 A 9/1998 Oni et al.
5,984,084 A 11/1999 Osaka et al.
6,053,306 A 4/2000 Osaka et al.
6,085,895 A 7/2000 Osaka et al.
6,125,807 A 10/2000 Nishi et al.
6,148,507 A * 11/2000 Swanson et al. ..... 29/816
6,233,803 B1 * 5/2001 Rose ..... 29/243.53
6,268,697 B1 7/2001 Nishida et al.
6,352,397 B1 3/2002 O'Quinn et al.
6,484,391 B1 * 11/2002 Dillon et al. ..... 29/790
2004/0010899 A1 * 1/2004 Winterhalter et al. ..... 29/252

* cited by examiner

FASTENER INSTALLATION APPARATUS AND ASSOCIATED METHOD

BACKGROUND OF THE INVENTION

The present invention relates to the installation of fasteners in structures, and, in particular, to the safe and controlled installation of interference-fit fasteners through holes in structures.

The fasteners that hold structures together, particularly those structures that are subject to significant dynamic forces and/or pressure over their lifetime, such as aircraft bodies, bridges, vehicle bodies, buildings, ships, train bodies, material handling and storage equipment, ladders, scaffolding, and others, must be properly secured in order to ensure that the structure will perform as intended over its lifetime. For example, fasteners are used to hold together various segments of the structure, such as layers of the structure or overlapping portions of the structure, and/or to attach any type of component to the structure.

In many applications, interference-fit fasteners are used to properly secure the parts of a structure, especially those structures that require particularly reliable and strong connections. One example of an interference-fit fastener is a HI-LOK™ fastener, commercially available from Hi-Shear Corporation of Torrance, Calif. Interference-fit fasteners are fasteners that are slightly larger than the hole into which they are inserted. Thus, when the fastener is installed in a hole that is slightly smaller than the fastener, the structure tightly holds the fastener and a secure connection between the fastener and the structure is created. Connections or joints utilizing properly installed interference-fit fasteners are also less likely to suffer from fatigue failure because the interference between the fastener and the structure results in a compressive preload in the structure. The interference between the fastener and structure also reduces the likelihood that debris, moisture, or any other element will enter into the fastener/structure interface, which can affect the integrity of the connection. In addition, interference fit fasteners do not tend to rotate or move when a nut or other fastener-holding component is attached to an end of an installed fastener. All of these properties and characteristics of interference-fit fasteners and connections make them advantageous as compared to other types of fasteners and connections.

In order to install interference-fit fasteners, several hundred pounds of force are generally required to push the fastener into the hole in the structure. Thus, an installer must utilize some type of tool to apply the necessary force to the fastener and push it into the hole in the structure. In the past, installers have generated the force in a variety of manners, such as by using prybars, rivet guns, slide hammers, or C-clamps. Most, if not all, of these techniques require considerable skill and care on the part of the installer to avoid damaging the adjacent/surrounding structure. In addition, these installation techniques are often unsafe and pose ergonomic hazards to the installer. For example, when using a prybar for leverage to apply force to a fastener, the prybar can easily slip because there is no way to secure the prybar to the structure. When the prybar slips, it can cause significant physical harm to the installer and/or damage to the structure. In addition, when using a rivet gun to apply force to the fastener, the rod of the rivet gun must be aligned precisely with the fastener and held steady by the installer as the rod makes contact with the fastener to force the fastener in the hole. Ensuring that the rod directly contacts the fastener is a very difficult task because there is no way to ensure that once the rod of the rivet gun is aligned with the fastener it will stay in that position during rivet gun operation because the installer holding the rivet gun may inadvertently move. Thus, the rod of the rivet gun may make contact with only part of the fastener or not at all, which may damage the fastener and/or the structure. Once the fastener and/or the structure are damaged, they must be repaired or replaced, which increases the time, labor and expense of the installation process.

Thus, there is a need to safely, reliably, and effectively install fasteners in structures, particularly interference-fit fasteners that require several hundred pounds of force be applied to the fastener in order to insert it into holes in the structures. The needed fastener installation technique should be easy to align, maintain alignment, and carry out, such that installers do not have to have specific skills in order to install fasteners in structures. In addition, the fastener installations should be faster than previous manners of fastener installation.

BRIEF SUMMARY OF THE INVENTION

The fastener installation apparatus and associated method of the present invention provide a safe technique for installing fasteners, particularly interference-fit fasteners, in holes defined by a structure. The fastener installation apparatus is also easy to use, such that installers do not need to have or obtain specific skills in order to install fasteners in structures. Furthermore, the fastener installation apparatus and method of the present invention ensure that the fastener is securely installed in a structure in order to hold a structure together and/or attach objects to the structure in a desired manner.

The fastener installation apparatus of the present invention includes a housing and a moveable body at least partially within the housing. The moveable body defines a plurality of openings and is fixably attached to at least one piston. The piston is in moveable contact with the housing and, most commonly, is in substantially air-tight contact with the housing. Thus, first and second cavities are defined on opposite sides of the piston and respective openings in the moveable body are in communication with the first and second cavities. In addition, a valve directs a fluid, such as a gas or a liquid, through respective openings in the moveable body and alternately into the first and second cavities, which, in turn, correspondingly extend and retract the moveable body relative to the housing. A jaw for at least partially supporting a fastener extends from the housing in alignment with the moveable body, such that the jaw and the moveable body cooperate to install a fastener upon extension of the moveable body.

The jaw and the moveable body may be spaced apart while the moveable body is retracted in order to receive, in the space between the jaw and the moveable body, the portion of the structure that defines the hole into which the shaft of the fastener is received. While the moveable body is retracted, a fastener may also be held by the jaw in alignment with the hole. As the moveable body is extended, the shaft of the fastener is inserted into the hole defined by the structure. Thus, the moveable body may define another opening, typically opening through the end of the moveable body, that is capable of receiving the shaft of the fastener. In addition, the moveable body may include an end cap that is aligned with the jaw and at least partially defines the opening that receives the shaft of the fastener. The end cap may be made of any type of non-marring material that will also withstand the impact when the moveable body is extended and contacts the side of the structure opposite the jaw.

The jaw of the fastener installation apparatus may rotate with respect to the housing. The jaw also may be detached from the housing, such that any one of a plurality of jaws may be connected to the housing.

The housing may be segmented into a number of chambers. Thus, in addition to including at least one piston, the fastener installation apparatus of the present invention may also include at least one partition. The partition may be fixedly attached to the housing and in moveable contact with the moveable body. Thus, each partition may be positioned within the housing relative to a respective piston in order to define one of the first and second cavities between the partition and the piston depending upon whether the partition is rearward or forward of the piston, respectively. In certain embodiments of the present invention, a plurality of pistons may be fixedly attached to the moveable body and spaced apart from each other, while a plurality of partitions may be fixedly attached to the housing and spaced apart from each other, such that the plurality of partitions are interdigitated with respect to the plurality of partitions. In these embodiments, the partitions and pistons may cooperate to define respective first and second cavities on opposite sides of each piston. The moveable body then may define a plurality of openings, where at least one opening is in communication with each of the first and second cavities. Moreover, the openings in communication with the first cavities may be in fluid communication and the openings in communication with the second cavities may be in separate fluid communication, such that all the first cavities and all the second cavities may be commonly pressurized.

The method for installing a fastener, according to the present invention, includes at least partially inserting the fastener in the hole defined by a structure and positioning the jaw near a first end of the fastener. Positioning the jaw may include aligning the jaw with the first end of the fastener. A moveable body is then positioned proximate a second end of the fastener on the opposite side of the structure from the jaw. Positioning the moveable body may include aligning an opening defined by the moveable body with the second end of the fastener. The moveable body is then moved toward the jaw such that the shaft of the fastener is driven into the hole in the structure and the opening in the moveable body receives the second end of the fastener.

Moving the moveable body toward the jaw may include controlling the movement of the moveable body relative to the housing, which may include controllably directing a fluid, such as a gas or liquid, into one of the first and second cavities. The fluid flow to a respective cavity may be controlled via a pneumatic valve and at least one opening in the moveable body that directs the fluid flow to the appropriate cavity. Thus, the moveable body may be moved toward the jaw by filling the first cavity disposed on a side of the piston that is opposite the structure with fluid. The moveable body may be moved away from the jaw after forcing the fastener into the hole by filling the second cavity disposed on the side of the piston facing the structure with fluid.

The apparatus and method of the present invention therefore provide a fluid flow between a respective opening and a respective first or second cavity that causes the moveable body to extend from or retract into the housing. Thus, when a fastener is aligned with a hole in a structure and both the fastener and structure are aligned with the jaw and the moveable body, the moveable body may extend from the housing and exert the necessary pressure to force the fastener into the structure. The installer, therefore, does not have to apply the force to the fastener directly because the apparatus creates and applies the necessary force, which is safer for the installer and less likely to harm the structure. In addition, once the installer aligns the fastener with the hole, jaw and moveable body, the apparatus performs the fastener installation, such that the installer does not have to possess specific skills in order to install fasteners.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The fastener installation apparatus and associated method of the present invention provide a safe technique for installing fasteners, particularly interference-fit fasteners, in holes defined by a structure. The fastener installation apparatus is also easy to use, such that installers do not have to have or obtain specific skills in order to install fasteners in structures. Furthermore, the fastener installation apparatus and method of the present invention ensures that the fastener is securely installed in a structure in order to hold a structure together and/or attach objects to the structure in a desired manner.

Figure 1:
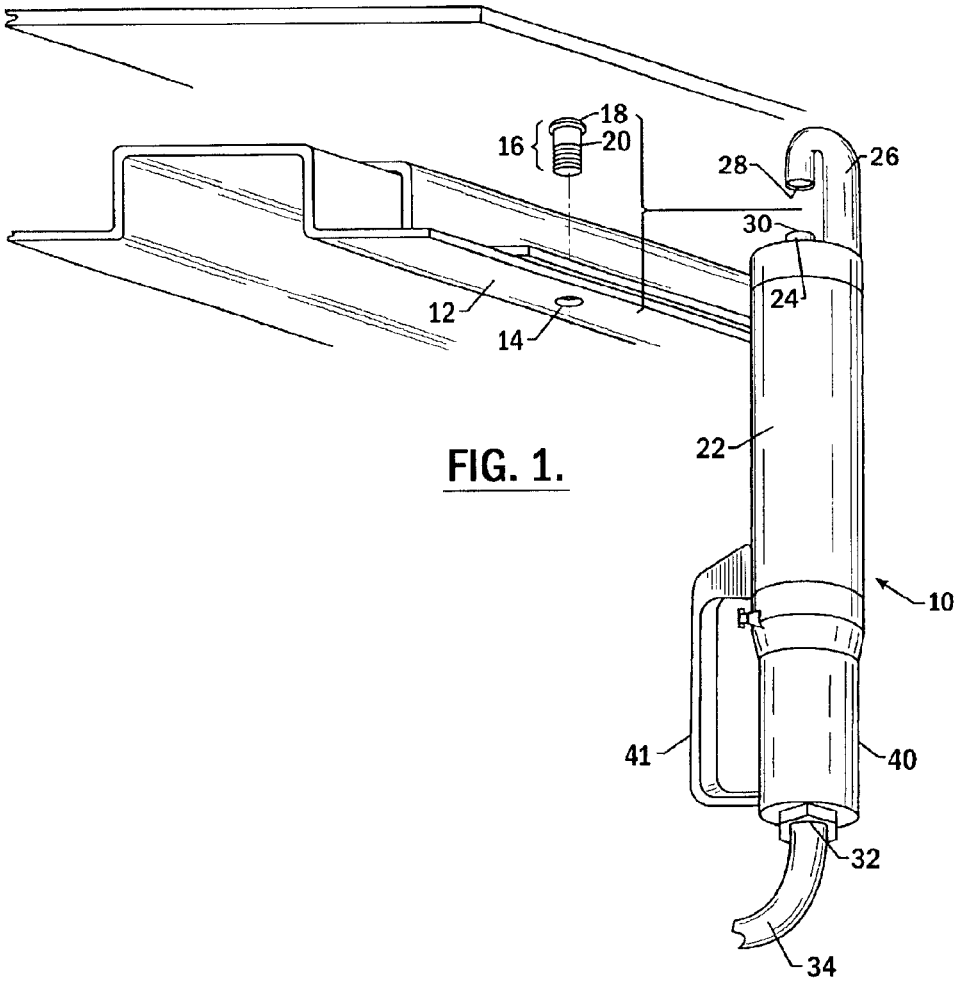
FIG. 1 is a perspective view of a fastener installation apparatus, a structure and a fastener, according to one embodiment of the present invention.

FIG. 1 illustrates the fastener installation apparatus 10 in conjunction with a structure 12 that defines at least one hole 14 into which a fastener 16 is to be installed. The structure 12 may be any type of workpiece(s) that are capable of receiving a fastener in order to attach segments of the structure together, to attach an object to the structure, or for any other reason. For example, FIG. 1 illustrates the fastener 16 aligned with a hole 14 in a stringer splice, such as the stringer splices used to assemble and support air vehicles. The fastener 16 in this example has a head 18 and shaft 20, but other fastener configurations may also be used with the fastener installation apparatus 10 of the present invention.

The fastener also may be an interference-fit fastener, such that the shaft 20 is larger than the hole 14 defined by the structure 12. One example of a commonly-used interference-fit fastener is a HI-LOK™ fastener, commercially available from Hi-Shear Corporation of Torrance, Calif. This fastener requires several hundred pounds of force in order to securely install the fastener into the hole in the structure.

Figure 2A:
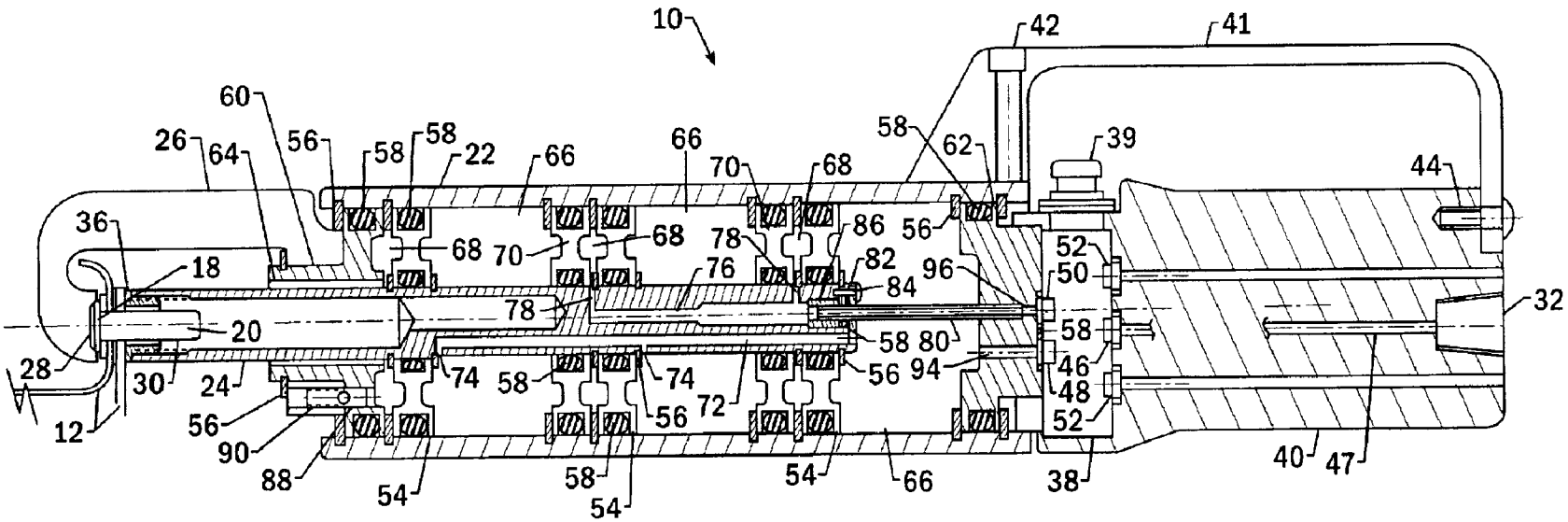
FIG. 2A is a cross-sectional view of the fastener installation apparatus in the extended position after the fastener is installed in the structure, according to one embodiment of the present invention.
Figure 2B:
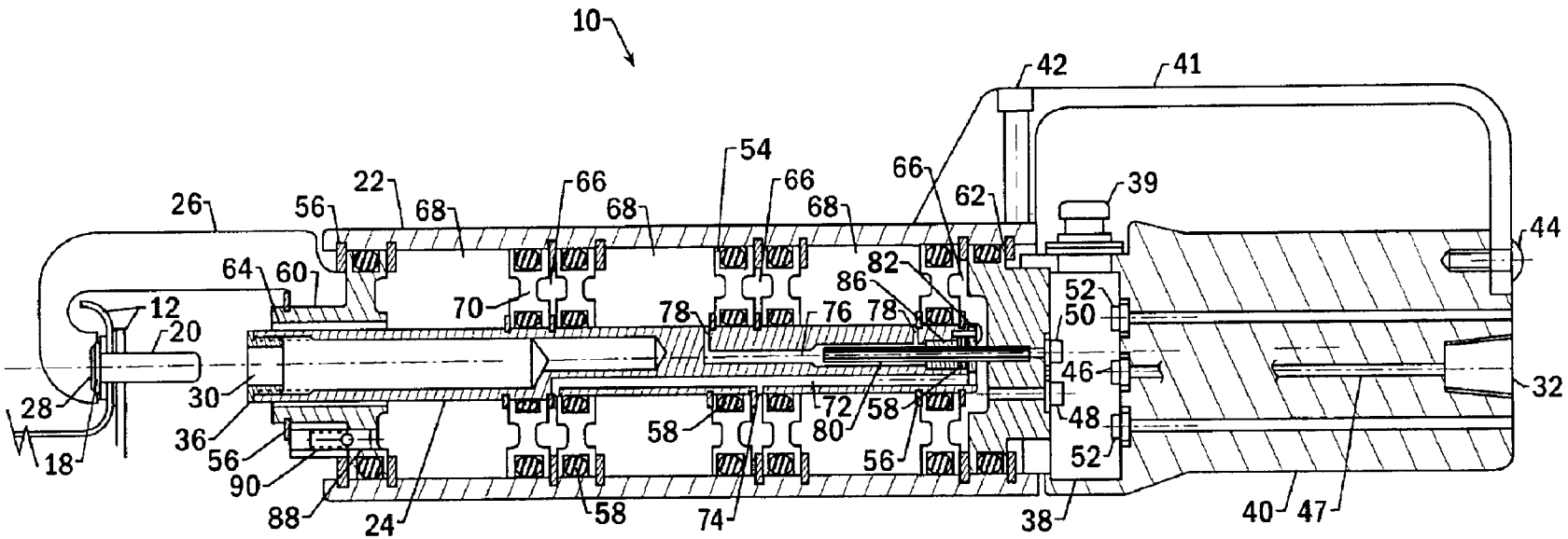
FIG. 2B is a cross-sectional view of the fastener installation apparatus in the retracted position after the fastener is installed in the structure, according to one embodiment of the present invention.

The fastener insertion apparatus 10 shown in FIGS. 1, 2A and 2B includes a housing 22 defining an internal cavity. The housing 22 may have a generally cylindrical shape or any other appropriate cross-sectional shape, such as rectangular or oval. The housing 22 may be made of any appropriate material having sufficient strength to withstand the internal pressure, such as aluminum and/or other metals, plastic, or composite materials. The housing 22 may include a handle 40 to facilitate holding and positioning the fastener installation apparatus 10, as shown in FIGS. 2A and 2B. In addition, a guard 41 may partially enclose a portion of the handle 40, particularly the portion of the handle proximate the actuator, such as the plunger 39 of the valve 38, which is described hereinbelow. The handle 40 and/or guard 41 also may be made of aluminum and/or other metals, plastic, or composite materials. The housing 22 may be formed integral with the handle 40 and/or guard 41, or the handle 40 and guard 41 may be attached to the housing 22 in any manner known to those skilled in the art, such as with bolts 42 and 44.

The housing 22 at least partially surrounds a moveable body 24, such that the moveable body 24 may move longitudinally through the housing so as to extend from and retract into the housing 22, as described hereinbelow. In order to permit the housing to be pressurized, the moveable body preferably extends through an opening defined by one end of the housing that is sized to be approximately equal to the size of the moveable body, as also described below. The moveable body 24 may have a generally cylindrical shape or any other appropriate cross-sectional shape. The moveable body 24 may be at least partially hollow in order to reduce the weight of the fastener installation tool 10, if desired. The moveable body 24 also may be made of any appropriate material, such as stainless steel and/or other metals, plastics, or composite materials. The strength of the material used to form the moveable body 24 must be sufficient to withstand the pressure required for the moveable body 24 to create the force necessary to install the fastener 16 into a structure 12.

The moveable body 24 may define a plurality of openings, including an opening 30 in the end of the moveable body 24 that extends from the housing 22. The opening 30 may receive the shaft 20 of the fastener 16 as the shaft 20 is inserted into the hole 14 defined by the structure 12. Thus, the end of the moveable body 24 that defines the opening 30 may contact the portion of the structure 12 proximate the hole 14 on the side of the structure 12 opposite the side from which the fastener is being installed, typically the inner surface of the structure. As such, as the fastener 16 is being installed in the structure 12, the opening 30 receives at least the distal end of the shaft 20 of the fastener. Because of the force with which the moveable body 24 may contact the structure 12, as explained hereinbelow, an end cap 36 may attach to the end of the moveable body 24 and at least partially define the opening 30. The end cap 36 may be attached in any manner known to those skilled in the art, such as by threading the end cap 36 onto the end of the moveable body 24 that is correspondingly threaded, or by pressing the end cap 36 onto the moveable body 36 utilizing an interference fit between the end cap 36 and the moveable body 24. The end cap 36, shown in FIGS. 2A and 2B, may be made of any non-marring material that is also strong enough to withstand the pressure required for the moveable body 24 to create the force necessary to install the fastener 16 into the structure 12. One example of such a material is Torlon™, a polyamide-imide material commercially available from Amoco Performance Products, Inc., Alpharetta, Ga.

The fastener installation apparatus 10 also includes a jaw 26 extending from the housing 22. As shown, the jaw 26 extends from the same end of the housing 22 through which the moveable body 24 extends. The jaw 26 is in alignment with moveable body 24 and cooperates with the moveable body 24 to install a fastener 16 in the structure 12. The jaw 26 may be generally C-shaped, such that one end of the C-shaped structure attaches to the housing 22 and the other end 28 of the C-shaped structure is spaced apart from and faces the end of the moveable body 24 that extends from the housing 22. The jaw 26 may be integrally formed as part of the housing 22, may attach directly to the housing 22, or may be attached to the housing 22 in any other manner known to those skilled in the art, such as the illustrated manner described hereinbelow.

The jaw 26 may be made of any type of material that is strong enough to withstand the pressure created by the moveable body 24 as the fastener 16 is installed in the structure 12. Thus, the jaw 26 must have sufficient strength to hold the fastener 16 in place as the moveable body 24 contacts the structure 12 and forces the fastener 16 into the hole 14 defined by the structure 12. Examples of jaw materials include steel and/or other metals, plastics, composite materials, and the like. To securely hold the fastener 16, the end 28 of the jaw 26 may be shaped to receive the head 18 of the fastener 16, such as by having a depression in the shape and size of the head of the fastener. Alternatively, the end 28 may be capable of attaching to various dies that are shaped to receive the heads of various fasteners. In this embodiment, the dies may be changed depending upon the type of fastener to be installed.

The housing 22 also may connect to some type of fluid source, such as a source of pressurized air or liquid. As shown in FIGS. 1, 2A, and 2B, the housing 22 may connect to the fluid source at the end of the housing 22 opposite the end that is connected to the jaw 26, represented by supply point 32. Thus, the fluid may be directed to supply point 32 by any means known to those skilled in the art, such as by a hose 34. Alternatively, the fluid source may connect to the housing 22 or other component, such as directly to the valve 38, which is described hereinbelow, at any appropriate point in order to supply the fluid to the proper locations, as also explained hereinbelow.

FIGS. 2A and 2B illustrate cross-sectional views of the fastener installation apparatus 10 according to certain embodiments of the present invention. FIG. 2A shows the moveable body 24 extended from the housing 22 to install the fastener 16 into the structure 12. FIG. 2B shows the moveable body 24 retracted into the housing 22 after fastener installation.

A cross-section of valve 38 is shown in FIGS. 2A and 2B. The valve 38 may be any type of device that controls the fluid flow through the housing 22. The valve 38 may be controlled by any type of actuator known to those skilled in the art, such as by a plunger 39 that controls the operation of the valve 38 depending upon whether it is depressed. For example, a four-way pneumatic valve, model number S01-0816, commercially available from Pneumadyne, Inc., Plymouth, Minn., may be used to direct air from an air supply and into the housing. Alternatively, a hydraulic valve may be used to direct liquid from a liquid supply through the housing. Thus, the valve 38 is in communication with the fluid supply directly at port 46 or via passage 47 that connects the port 46 to the supply point 32 of the handle 40. In the illustrated embodiment, the valve 38 directs the fluid that enters via port 46 through either port 48 or port 50, depending upon the desired position of the moveable body 24, as described hereinbelow. The valve 38 also may release the fluid that is present in the housing 22 through at least one channel 52.

The valve 38 may be located between the housing 22 and the handle 40 such that an operator may easily access the plunger 39 while maintaining a distance from the installation site. For example, when the plunger 39 is depressed, fluid may enter the valve 38 at port 46 and port 48 may be opened to direct the fluid to those areas within the housing 22 that are in communication with port 48, as described herein below. As the fluid is entering the housing 22 via port 48, any fluid present in the housing 22 that is in communication with port 50 may exit the housing via port 50 and be recirculated through port 48 or vented through channel(s) 52. In the same way, when the plunger 39 is not depressed, fluid may enter the valve 38 at port 46 and port 50 may be opened to direct the fluid to those areas within the housing 22 that are in communication with port 50, as described herein below. As the fluid enters the housing 22 via port 50, any fluid present in the housing 22 that is in communication with port 48 may exit the housing via port 48 and be recirculated through port 50 or vented through channel(s) 52. In order to recirculate the fluid in certain embodiments of the fastener insertion tool of the present invention, such as embodiments utilizing a closed hydraulic system, the fluid may be exhausted through port 52, then directed back into supply point 32.

To facilitate movement of the moveable body 24, the moveable body 24 is attached to at least one piston 54. The piston 54 may be attached to the moveable body 24 in any manner known to those skilled in the art, such as by snap rings 56, commercially available from Applied Industrial Technologies, Seattle, Wash. The piston 54 may be made of any appropriate material, such as any type of appropriate metal, plastic or composite material capable of withstanding the internal pressures. In a specific embodiment, the piston 54 is made of nickel-aluminum bronze. The piston 54 is also in moveable contact with the housing 22. To facilitate movement between the piston 54 and the housing 22 and to create a seal between the piston 54 and the housing 22, a seal member 58, which, in the illustrated embodiments, is an O-ring seal, commercially available from Eriks West, Seattle, Wash., may be located between the piston 54 and the housing 22. This type of seal member 58 also may be located between the piston 54 and the moveable body 24 to ensure that fluid on one side of the piston 54 cannot leak to the other side of the piston 54.

The housing 22 may include not only the generally tubular body, but also opposed integral ends for at least partially closing the housing. As shown in the illustrated embodiments, however, caps 60, 62 may attach to the distal end of the housing 22 from which the jaw 26 extends and the proximal end of the housing 22 proximate the valve 38, respectively. As such, at least one piston 54 is located within the housing between caps 60, 62. The caps 60, 62 may be made of any appropriate material, such as any type of metal, plastic or composite material capable of withstanding the internal pressures. In a specific embodiment, cap 60 is made of steel and cap 62 is made of aluminum. In addition, the caps 60, 62 may be attached to the housing 22 in any manner known to those skilled in the art. As illustrated, the caps may be attached to the housing 22 with a snap ring 64. In addition, to ensure that fluid within the housing 22 does not leak out about the caps 60, 62 and the housing 22, seal members 58, which, in the illustrated embodiments, are O-ring seals, may be located between the caps 60, 62 and the housing 22.

Cap 60 may define an opening through which the moveable body 24 may extend and retract. As such, the opening defined by cap 60 may be at least partially defined by a bushing 64. The circumference of the opening defined by the bushing 64 may be slightly larger than the circumference of the moveable body 24 in order to facilitate movement of the moveable body 24 through the opening in cap 60. The bushing 64 may be made of any type of appropriate material capable of withstanding the internal pressure and having a relatively low coefficient of friction, such as any type of metal, plastic or composite material. In a specific embodiment, the bushing 64 is made of nickel-aluminum bronze.

Furthermore, jaw 26 may be detachably connected to the housing 22 or, in the illustrated embodiment, to the cap 60 by any manner known to those skilled in the art, such as with a snap ring 56. The snap ring 56 may be applied about the cap 60 to sandwich the end of the jaw 26 that at least partially surrounds a mid-portion of the cap 60, between the portion of the cap 60 that attaches to the housing 22 and the snap ring 56.

Figure 3:
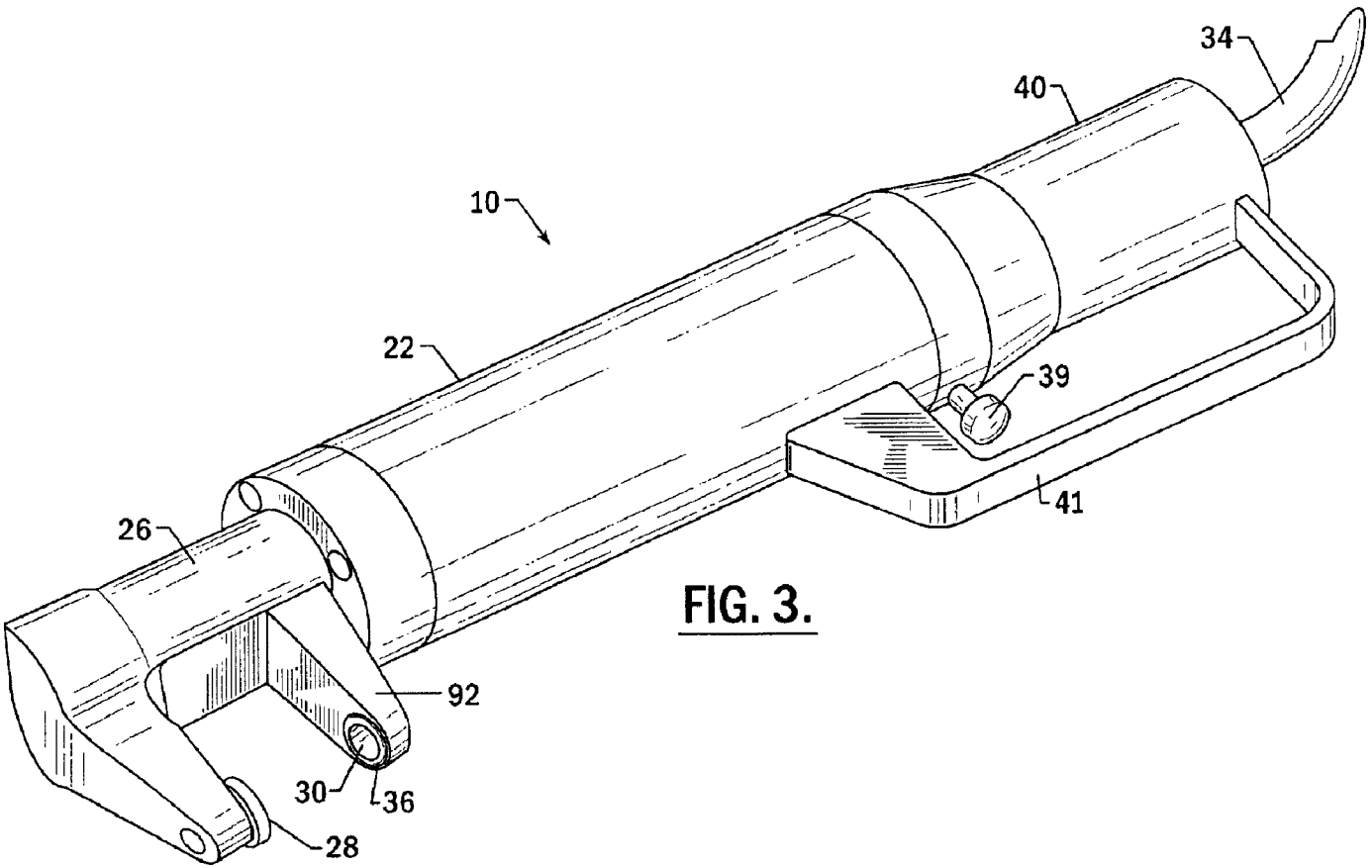
FIG. 3 is a perspective view of the fastener installation apparatus with an alternate jaw configuration, according to one embodiment of the present invention.

Detachably connecting the jaw 26 to the cap 60 permits connecting any one of multiple jaws 26 having various configurations to the cap 60. The various jaw 26 configurations may be designed in order to install various types and/or sizes of fasteners into various structures and/or locations in structures. For example, FIG. 3 illustrates an alternate jaw 26 configuration extending from housing 22. This jaw 26 is designed to install fasteners in locations of a structure that are not accessible with the jaw and moveable body configuration shown in FIGS. 1, 2A and 2B. Therefore, the end 28 of this jaw 26 extends beyond the housing 22, both longitudinally and laterally, to reach interior areas of the structure. The apparatus of this embodiment also includes an opposed jaw member 92 carried by or otherwise moveable in conjunction with the moveable body 24. The opposed jaw member 92 is spaced from and in alignment with the end 28 of the jaw 26 for receiving a fastener therebetween. The opposite jaw member 92 defines an opening 30 in alignment with the end 28 of the jaw 26 and, in turn, with the hole in the structure in order to receive the shaft 20 of the fastener 16 as it is installed, as described hereinbelow.

Furthermore, the jaw 26 may be rotatably connected to the cap 60 in any manner known to those skilled in the art. In the illustrated embodiments, cap 60 includes ball detents 88 that are capable of receiving ball plungers 90 that are located at the end of the jaw 26 that faces the cap 60. One example of the ball detents 88 and ball plungers 90 are CL-3-BD and CL-22-BP-1, respectively, commercially available from E. F. Bailey, Inc., Seattle, Wash. Thus, the ball detents 88 and ball plungers 90 cooperate to rotatably connect the jaw 26 to the cap 60. In the illustrated embodiment, the jaw 26 rotates with respect to the housing 22 by applying enough force to the jaw 26 and/or housing 22 relative to each other, such that each ball plunger 90 is removed from a respective ball detent 88 and the jaw 26 is rotated until each ball plunger 90 is received by another ball detent 88. Thus, if there are four ball plungers 90 evenly spaced about the jaw 26 and four ball detents 88 evenly spaced about the cap 60, the jaw 26 may rotate with respect to the housing 22 and be secured in the cap 60 every ninety-degrees. The more or less evenly spaced ball plungers 90 about the jaw 26 and ball detents 88 about cap 60, the more or less positions of rotation of the jaw 26 with respect to the housing 22, respectively.

Cap 62 may define openings 94, 96 that are in communication with ports 48, 50, respectively, of valve 38. The openings 94, 96 facilitate the movement of fluid into and out of the housing 22 as controlled by the valve 38. To ensure a secure seal between ports 48, 50 and the openings 94, 96 in cap 62, sealing members 58 may be located between each port and the respective opening. In the illustrated embodiments, the sealing members 58 are O-rings.

The moveable body 24 also may include at least one opening to facilitate the flow of fluid within the housing 22 on either side of the at least one piston 54. Thus, fluid must be able to fill the first cavity or cavities 66 on the side of piston(s) 54 that face cap 62 in order to extend the moveable body 24 by forcing the piston(s) 54 and, in turn, the moveable body 24 toward the jaw 26. In addition, fluid must be able to fill the second cavity or cavities 68 on the side of the piston(s) 54 that face cap 60 in order to retract the moveable body 24 by forcing the piston(s) 54 and, in turn, the moveable body 24 away from the jaw 26.

In order to increase the force capable of being applied to the fastener, the apparatus 10 may include a plurality of pistons, typically evenly spaced along the moveable body 24. When more than one piston 54 is utilized in the fastener installation apparatus 10 of the present invention, then partition(s) 70 may be located between pistons 54 in order to segment the housing 22 and to create first and second cavities 66, 68 on the opposite sides of each piston 54. The partitions 70 are attached to the housing 22 and are in moveable contact with the moveable body 24. In the illustrated embodiments of the fastener installation apparatus 10 of the present invention, the partitions 70 have the same form and composition as the pistons 54 and are also evenly spaced along the length of the housing 22. The partitions 70 may be attached to the housing 22 in any manner known to those skilled in the art, such as with snap rings 56. Furthermore, sealing members 58 may be located between the partitions 70 and the moveable body 24 in order to facilitate movement of the moveable body 24 relative to the partitions 70 while ensuring a secure seal between the partitions 70 and the moveable body 24. In the illustrated embodiments, the sealing members 58 are O-rings.

In general, the more pistons 54 and associated partitions 70 utilized to create additional first and second cavities 66, 68, the more force generated by the fastener installation apparatus 10 of the present invention as the moveable body 24 is extended from the housing 22. Thus, the number of piston(s) 54 utilized in a specific embodiment of the fastener installation apparatus 10 of the present invention may depend upon the amount of force necessary in order to force the particular fastener 16 into the hole 14 defined by a structure 12.

FIGS. 2A and 2B illustrate embodiments of the fastener installation apparatus 10 of the present invention that utilize three pistons 54. As such, to extend the moveable body 24 from the housing 22, as shown in FIG. 2A, first cavities 66 are filled with the fluid. The moveable body 24, therefore, may define a lengthwise extending passage 72 having openings 74 into the first cavities 66, on the side of each piston 54 that faces cap 62. Thus, there is no need for an opening on the side of each piston 54 that is closest to the cap 62 because the fluid can communicate directly with that piston without any obstructions.

When the moveable body 24 is retracted into the housing 24, as shown in FIG. 2B, second cavities 68 are filled with fluid. The moveable body 24, therefore, also may define a lengthwise extending passage 76 having openings 78 into the second cavities 68 on the side of each piston 54 that faces cap 60. Because there is generally not a requirement that the moveable body 24 retract into the housing 22 with the amount of force required when the moveable body 24 is extended from the housing, a need typically does not exist to provide an opening into the second cavities 68 on the side of the piston 54 facing the cap 60 for the piston 54 that is closest the cap 60. Certain embodiments may include an opening in that cavity, however, depending upon the specific application.

To ensure that the fluid is received only in second cavities 68 via openings 78, port 50 may be directly connected to the lengthwise extending passage 76 via tubular member 80. As such, tubular member 80 may extend between port 50 and/or the opening 96 in cap 62 in communication with port 50 and the passage 76 in the moveable body 24. Thus, when valve 38 is in the appropriate position, the fluid moves through port 50, tubular member 80, passage 76 and openings 78 to fill the second cavities 68, such that all of the second cavities 68 are at the same pressure.

The tubular member 80 may be made of any type of appropriate material, such as metal, plastic or composite material. In a specific embodiment, tubular member 80 is made of nickel-aluminum bronze. To simplify the manufacture of the moveable body 24, an end cap 82 and a plug 86 may at least partially define the entrance into the lengthwise extending passage 76. The end cap 82 and plug 86 are used in conjunction to form an internal groove within moveable body 24. Alternatively, an internal groove may formed in the moveable body 24 in any other manner known to those skilled in the art, such as by machining an internal groove in moveable body 24. The end cap 82 and plug 86 may be attached to the moveable body 24 in any manner known to those skilled in the art. In the illustrated embodiment, the end cap 82 and plug 86 are attached to the moveable body via bolt 84. The end cap 82 and plug 86 may be made of any appropriate material, such as metal, plastic, rubber, or composite material. In a specific embodiment, the end cap 82 and the plug 86 are made of stainless steel. A sealing member 58, such as an O-ring, may be placed at the intersection of the end cap 82 and the plug 86 in order to seal passage 76 from the cavity 66 that is closest to the cap 62. As such, when the moveable body 24 is retracted into the housing 22, the sealing member 58 prevents high pressure fluid in the passage 76 from moving into cavity 66 where low pressure fluid is located. In addition, when the moveable body 24 is extended, the sealing member 58 prevents high pressure fluid in the cavity 66 from moving into passage 76 where low pressure fluid is located.

To fill the first cavities 66 with fluid, valve 38 directs the fluid through port 48, which is in communication with the first cavity located on the backside of the closest piston 54. This first cavity is in communication with passage 72 defined by the moveable body 24, and passage 72 is in communication with the other similar first cavities 66 via openings 74. Thus, the fluid moves into the other first cavities 66, such that all of the first cavities 66 are at the same pressure.

The method for installing a fastener 16 in a structure 12 utilizing the fastener installation apparatus 10 of the present invention includes initially aligning and at least partially inserting the fastener 16 in a hole 14 defined by the structure 12. Thus, for an interference-fit fastener 16, the circumference of the distal end of the shaft 20, may be slightly smaller than the circumference of the hole 14, such that only the distal end of the shaft 20, which may be chamfered, may be inserted in the hole 14 initially. The jaw 26 and the moveable body 24 then may be aligned with the fastener 16. The end 28 of the jaw 26 is aligned with the end of the fastener 16 that is opposite the distal end of the shaft 20. For instance, if the fastener 16 has a head 18, the end 28 is aligned with the head 18. The opening 30 of the moveable body 24 is aligned with the shaft 20 of the fastener 16 on the opposite side of the structure 12 from the jaw 26.

The moveable body 24 is then moved toward the jaw 26. In the illustrated embodiments, the moveable body 24 is moved by activating the valve 38, such as by depressing the plunger 39 or any other means of activating the valve 38 known to those skilled in the art. The valve 38 then directs fluid entering the valve 38 via the supply point 32, passage 47 and port 46 through port 48 and into the first cavities 66 in the housing 22 that are in communication with port 48 via the opening 94 in cap 62, and passage 72 and openings 74 of the moveable body 24. As described above, the fluid is directed to the side of the pistons 54 that face the cap 62, which forces the pistons 54 toward the jaw 26 by filling the first cavities 66 with the fluid. Because the pistons 54 are attached to the moveable body 24, the moveable body 24 is also forced toward the jaw 26, such that the opening 30 of the moveable body 24 receives the shaft 20 of the fastener 16 and the moveable body 24 is in operable contact with the structure 12. This movement of the moveable body 24 also causes the jaw 26 to force the end of the fastener 16 that is opposite the distal end of the shaft 20 into the hole 14, as shown in FIG. 2A. Any fluid present in the housing 22 on the side of the pistons 54 facing the cap 60, i.e., second cavities 68, as the fluid entered the housing 22 on the side of the pistons 54 facing the cap 62, is at least partially vented from the housing 22 via the openings 78, the passage 76, tubular member 80, port 50 and channel(s) 52 in order to permit the cavities 66 to fill with fluid.

Once the fastener 16 is installed, the moveable body 24 may retract away from the jaw 26 and into the housing 22, as shown in FIG. 2B. Thus, the moveable body 24 is moved by activating the valve 38, such as by releasing the plunger 39 or any other means of activating the valve 38 known to those skilled in the art. The valve 38 then directs fluid entering the valve 38 via the supply point 32, passage 47 and port 46 through port 50 and tubular member 80, and into the second cavities in the housing 22 that are in communication with port 50 and tubular member 80 via passage 76 and openings 78. As described above, the fluid is directed to the side of the pistons 54 that face the cap 60, which forces the pistons 54 away from the jaw 26 by filling the second cavities 68 with the fluid. Because the pistons 54 are attached to the moveable body 24, the moveable body 24 is also forced away from the jaw 26 and tubular member 80 is received by the passage 76 in the moveable body 24 as described above. This movement of the moveable body 24 causes the jaw 26 and the moveable body to release the fastener 16 and the structure 12. Therefore, the fastener installation apparatus 10 may be removed from the fastening area and the fastener may be further secured to the structure, such as by application of a collar or nut to the shaft 20 of the installed fastener 16. Any fluid present in the housing 22 on the side of the pistons 54 facing the cap 62, i.e., first cavities 66, as the fluid entered the housing 22 on the side of the pistons 54 facing the cap 60, is at least partially vented from the housing 22 via the openings 74, the passage 72, and/or the port 48 and channel(s) 52 in order to permit the second cavities 68 to fill with fluid.

Thus, the fastener installation apparatus 10 and associated method of the present invention provide safe and efficient fastener installation into holes defined by structures. The apparatus 10 and method are safe because the installer does not have to physically supply the force necessary to install a fastener using awkward tools or methods that are prone to operator error because the apparatus 10 provides the necessary force while the operator stays safely removed from the actual installation site. In addition, the apparatus 10 utilizes fluid to fill cavities within a housing 22 that forces a moveable body 24 to move toward a jaw 26, such that the operator of the apparatus does not experience harmful ergonomic effects. The apparatus 10 is also capable of installing fasteners in structures faster than conventional techniques, which saves time, labor and expense in an assembly process, and permits the resulting product to be finished faster. Furthermore, the resulting product that is made by utilizing the fastener installation tool of the present invention is of better quality than those manufactured using conventional fastener installation techniques because the fastener insertion tool of the present invention does little or no damage to the structure, and the fasteners are installed in a uniform manner, unlike the conventional fastener installation techniques.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A fastener installation apparatus, comprising:

a housing;

a moveable body at least partially within said housing and adapted to move in a lengthwise direction through said housing, wherein said body defines a plurality of openings;

at least one piston fixedly attached to said moveable body and in moveable contact with said housing to thereby define first and second cavities on opposite sides of the piston and separated from one another in the lengthwise direction by the piston, wherein said moveable body defines respective openings in communication with the first and second cavities that are separated from one another in the lengthwise direction on opposite sides of the piston;

a valve that is capable of alternately directing a fluid through a respective opening defined by the moveable body and into the first cavity and then through another respective opening defined by the moveable body and into the second cavity such that the moveable body is capable of being alternately extended and retracted in the lengthwise direction relative to the housing; and a jaw extending from said housing in alignment with said moveable body such that the jaw and moveable body cooperate to install a fastener upon extension of the moveable body.

2. The fastener installation apparatus of claim 1, wherein said jaw is also in alignment with a fastener having a head and a shaft, wherein said jaw and the moveable body are spaced apart while the moveable body is retracted so as to be capable of receiving a portion of the structure that defines a hole to receive the shaft of the fastener in the space between the jaw and the moveable body.

3. The fastener installation apparatus of claim 2, wherein said moveable body defines another opening capable of receiving the shaft of the fastener.

4. The fastener installation apparatus of claim 3, wherein said movable body comprises an end cap, and wherein the end cap is aligned with said jaw and at least partially defines the opening that is capable of receiving the shaft of the fastener.

5. The fastener installation apparatus of claim 4, wherein the end cap is made of a non-marring material.

6. The fastener installation apparatus of claim 1, wherein said jaw is rotatably connected to said housing.

7. The fastener installation apparatus of claim 1, wherein said jaw is detachably connected to said housing.

8. The fastener installation apparatus of claim 7, wherein said jaw is one of a plurality of jaws capable of being detachably connected to said housing.

9. The fastener installation apparatus of claim 1, wherein the piston is in substantially air-tight contact with said housing.

10. The fastener installation apparatus of claim 1, further comprising at least one partition fixedly attached to said housing and in moveable contact with said moveable body, each partition positioned within said housing relative to a respective piston to define one of the first and second cavities therebetween.

11. The fastener installation apparatus of claim 10, wherein said at least one piston comprises a plurality of pistons fixedly attached to said movable body and spaced apart from one another, and wherein said at least one partition comprises a plurality of partitions fixedly attached to said housing, said plurality of partitions being spaced apart from one another and interdigitated with respect to said plurality of pistons.

12. The fastener installation apparatus of claim 11, wherein said housing, said plurality of partitions and said plurality of pistons cooperate to define respective first and second cavities on opposite sides of each piston, and wherein said moveable body defines a plurality of openings with at least one opening in communication with each of the first and second cavities.

13. The fastener installation apparatus of claim 12, wherein said moveable body defines the openings such that all openings in communication with a first cavity are in fluid communication and such that all openings in communication with a second cavity are in fluid communication.

14. A method for installing a fastener, comprising:

at least partially inserting the fastener in a hole defined by a structure;

positioning a jaw proximate a first end of the fastener;

positioning a moveable body defining at least one opening proximate a second end of the fastener on an opposite side of the structure from the jaw;

moving the moveable body toward the jaw such that the moveable body is in operable contact with the structure and such that further movement of the moveable body causes the jaw to force the fastener further into the hole; and receiving the second end of the fastener within the opening defined by the moveable body in response to movement of the moveable body such that further movement of the moveable body toward the jaw causes the fastener to be inserted further into the opening defined by the moveable body.

15. The method of claim 14, wherein positioning the jaw comprises aligning the jaw with the first end of the fastener.

16. The method of claim 14, wherein positioning the moveable body comprises aligning the opening defined by the body with the second end of the fastener.

17. The method of claim 14, wherein moving the moveable body toward the jaw comprises controlling movement of the moveable body relative to a housing at least partially surrounding the moveable body.

18. The method of claim 17, wherein moving the moveable body comprises moving the moveable body in a lengthwise direction through the housing, and wherein controlling movement of the moveable body relative to the housing comprises controllably and alternately directing a fluid into one of first and second cavities defined within the housing and separated from one another in the lengthwise direction on opposite sides of a piston that is fixedly attached to the moveable body and in moveable contact with the housing.

19. The method of claim 18, wherein moving the moveable body toward the jaw further comprises filling the first cavity disposed on an opposite side of the piston in the lengthwise direction from the structure with fluid.

20. The method of claim 18, further comprising moving the moveable body away from the jaw after forcing the fastener into the hole by filling the second cavity disposed in the lengthwise direction on a side of the piston facing the structure with fluid.

21. The method of claim 18, wherein controllably directing the fluid comprises controlling the fluid flow to the first cavity via a pneumatic valve and at least one opening defined by the moveable body that direct the fluid flow to a first side of the piston.

22. The method of claim 18, wherein controllably directing the fluid comprises controlling the fluid flow to the second cavity via a pneumatic valve and at least one opening defined by the moveable body that direct the fluid flow to a second side of the piston.

23. The method of claim 14, further comprising rotating the jaw about the moveable body.

24. The method of claim 14, further comprising detachably connecting the jaw to a housing that at least partially surrounds the moveable body such that one jaw may be detached and another jaw may be attached to the housing.

* * * * *